US005269421A

United States Patent [19]

Taylor

[11] Patent Number: 5,269,421

[45] Date of Patent: Dec. 14, 1993

[54] PACKAGE OF PRESSURE SENSITIVE ADHESIVE TAPE

[75] Inventor: David F. Taylor, Hickory, N.C.

[73] Assignee: Shuford Mills, Inc., Hickory, N.C.

[21] Appl. No.: 963,068

[22] Filed: Oct. 19, 1992

[51] Int. Cl.[5] ..... B65D 85/672

[52] U.S. Cl. ..... 206/411; 206/813

[58] Field of Search ..... 206/411, 412, 410, 813, 206/49, 388, 389; 53/438, 529

[56] References Cited

U.S. PATENT DOCUMENTS

| | | | |
|---|---|---|---|
| 566,424 | 8/1896 | Smith . | |
| 579,800 | 3/1897 | Leveritt . | |
| 782,092 | 2/1905 | Wolff . | |
| 933,189 | 9/1909 | Linnell . | |
| 1,915,815 | 6/1933 | Camp . | |
| 2,035,196 | 3/1936 | Schiek . | |
| 2,109,583 | 3/1938 | Bennett . | |
| 2,249,424 | 7/1941 | Hanington . | |
| 2,792,110 | 5/1957 | Wanish . | |
| 3,006,464 | 10/1961 | Snell | 206/411 X |
| 3,568,829 | 3/1971 | Brady . | |
| 3,858,719 | 1/1975 | Isaacs . | |
| 4,909,388 | 3/1990 | Watanabe | 206/410 |

*Primary Examiner*—William I. Price

*Attorney, Agent, or Firm*—Bell, Seltzer, Park & Gibson

[57] ABSTRACT

A package of pressure sensitive tape having an overall size and shape so as to readily fit into the pocket of a garment such as a shirt for ease in carrying and for ready accessibility. The package comprises a relatively thin, stiff and short two-ply core and a length of pressure sensitive tape convolutely wound around the two-ply core to form a plurality of layers.

7 Claims, 2 Drawing Sheets

PACKAGE OF PRESSURE SENSITIVE ADHESIVE TAPE

BACKGROUND OF THE INVENTION (1) Field of the Invention

This invention relates to a package of flat wound pressure sensitive tape having an overall size to conveniently fit into the pocket of a garment, such as a shirt. More particularly, this invention relates to a package of pressure sensitive cloth tape convolutely wound around a relatively stiff two-ply rectangular core and to a method for making same.

(2) Description of the Prior Art

Pressure sensitive tapes of the cloth variety were originally developed for use in sealing joints in heating and air conditioning duct work but tapes of this type have found many other uses as they are frequently a staple in the tool box of, not only of the professional, but also the handyman.

Pressure sensitive tape is traditionally wound on a round core. The diameter varies, but the cores are always round. Actually, that is why such products are known as "rolls of tape". The typical roll of duct tape is about 2" wide and 3¼" to 4" in diameter. Duct tape packaged in this form has the disadvantage in that they are inconvenient or difficult to carry on one's person, especially to fit into a pocket, such as a shirt pocket. There are frequent times when the user of the tape needs only a short portion, say from one to two feet to make a patch, for example, and finds that carrying a bulky "roll" to be somewhat cumbersome.

SUMMARY OF THE INVENTION

In accordance with the present invention, a package of pressure sensitive tape having an overall size that readily fits into the pocket of a garment such as a shirt for ease in carrying and ready accessibility is provided. The tape package comprises a relatively thin, stiff and short two-ply rectangular core, and a predetermined length of pressure sensitive tape convolutely wound around the two-ply rectangular core to form a plurality of superimposed layers. The present invention has been found particularly suited for pressure sensitive cloth tapes such as those commonly known as "duct tape". The width of the pressure sensitive tape is substantially the same width as the core.

The core member may be a cylindrical member which has been pressed flat to form a two-ply core. When pressed flat, the core member has a rectangular shape. Alternatively, the two-ply core member may be two separate rectangular pieces such as a pair of relatively thin, stiff rectangular juxtapositioned core members, each of substantially the same size. When this embodiment is used, the two-ply core member has means looped around and connected to opposite ends of the core members to maintain the core members in close juxtaposition to each other to provide the desired overall thickness of core and for facilitating the winding of the core. The core member may be plastic or the more traditional paperboard. The thickness of the core member must be such as to maintain the stiffness necessary to support the wound tape. More specifically, the thickness of the wound pressure sensitive tape on each side of said core is not greater than the overall thickness of said core so as to provide a relatively small package for facilitating handling thereof.

It is therefore an object of this invention to provide a package of pressure sensitive tape which has an overall size to readily fit in the pocket of a garment such as a shirt.

Another object of the present invention is to provide a package of pressure sensitive cloth tape convolutely wound on a two-ply rectangular core.

BRIEF DESCRIPTION OF THE DRAWINGS

Other objects, features and advantages of the present invention will become apparent from the following description of the preferred embodiments taken in conjunction with the accompanying drawings, in which.

DETAILED DESCRIPTION OF THE INVENTION

Figure 1:
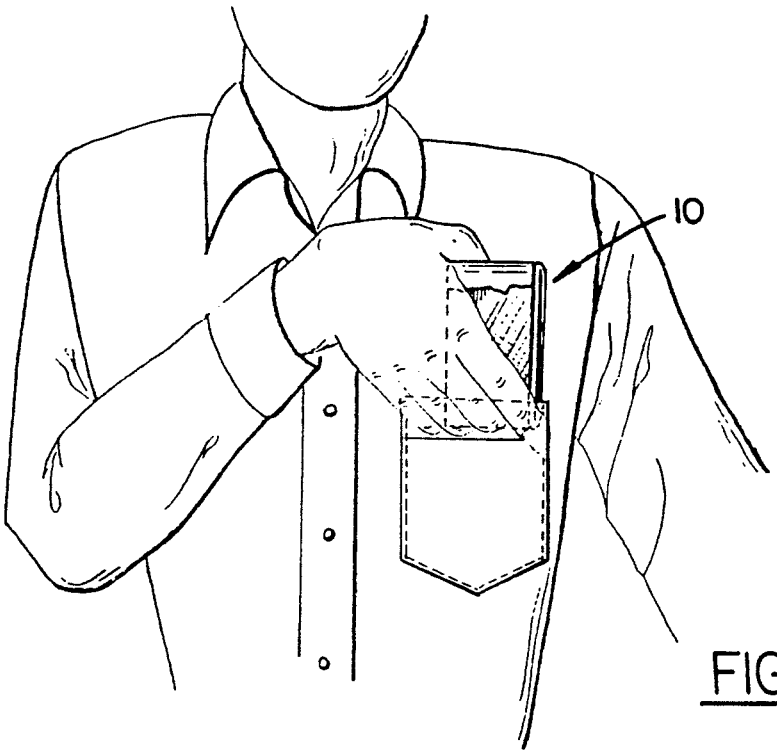
FIG. 1 illustrates a package of pressure sensitive tape of the present invention being placed into a shirt pocket.

Referring first to FIG. 1, there is shown a package lo of pressure sensitive tape, such as duct tape, of such a size as to easily fit into a shirt pocket. The overall size makes the package convenient to carry and is readily accessible.

Figure 2:
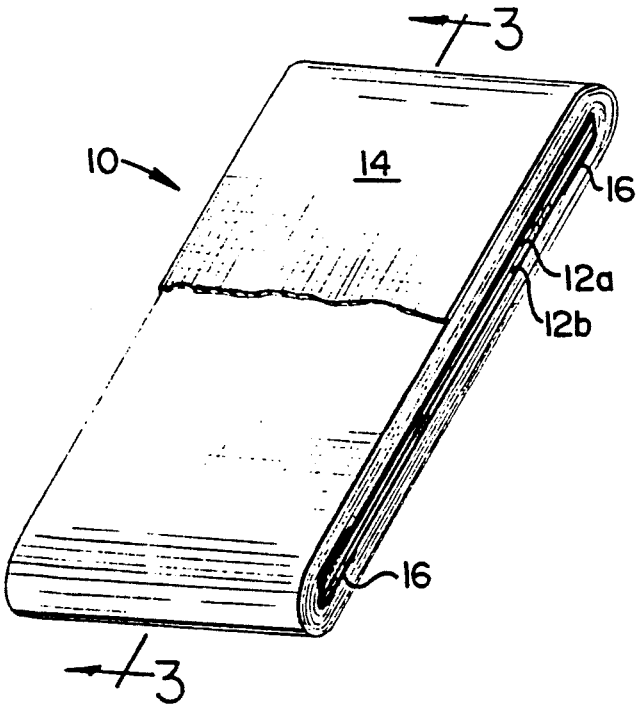
FIG. 2 is a perspective view of a package of pressure sensitive tape in accordance with the present invention.

Referring now to FIG. 2, there is shown a package 10 of pressure sensitive tape having a predetermined length of pressure sensitive tape 14 convolutely wound around a core to form a plurality of superimposed layers. Typically, each package of tape will contain from 10' to 20' of tape. If too much tape is wound on the core, it will be too heavy or bulky for a shirt pocket.

Figure 3:
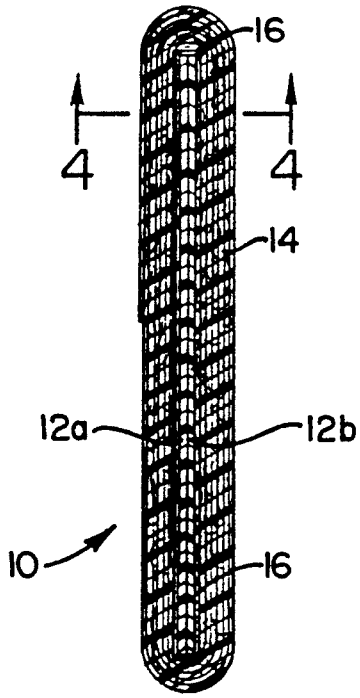
FIG. 3 is a side view of the pressure sensitive tape product of taken along line 3—3 of FIG. 2'
Figure 6:
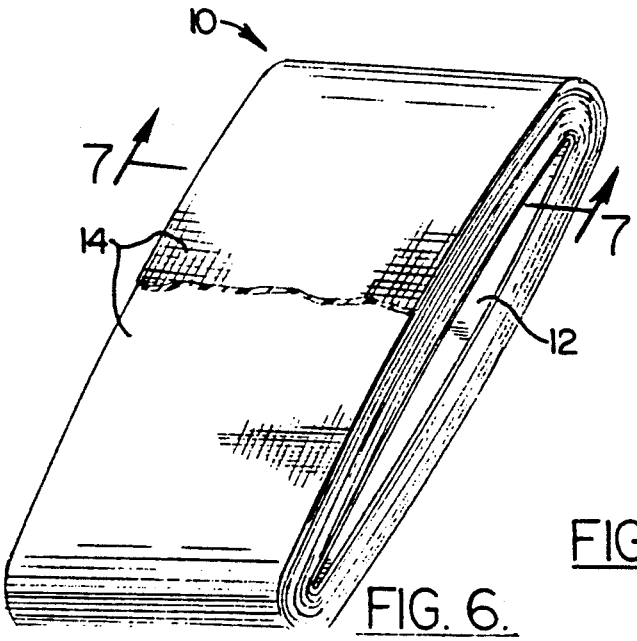
FIG. 6 is a perspective view of another embodiment of a package of pressure sensitive tape in accordance with the present invention.
Figure 7:
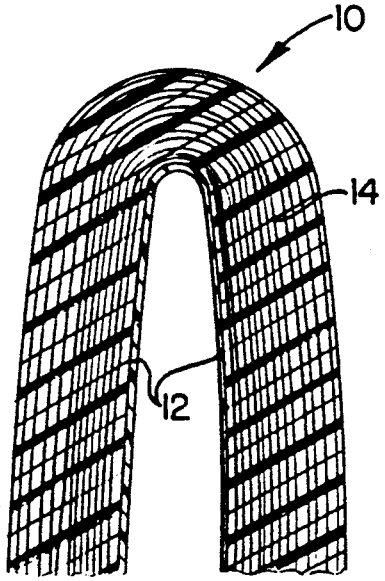
FIG. 7 is an enlarged view of a core member of an embodiment of the present invention taken along line 7—7 of FIG. 6.

In one embodiment such as shown in FIG. 6 and FIG. 7, the core member is a cylindrical member 12 that has been permanently altered by compression into a relatively flat, thin, stiff two-ply member having a rectangular shape. In another embodiment, such as the embodiment shown in FIGS. 2–4, the core comprises two pieces of substantially the same size in close juxtaposition to each other.

Figure 4:
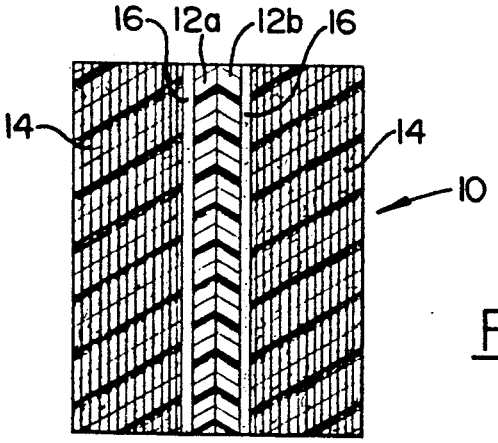
FIG. 4 is an enlarged view of a core member of one embodiment of the present invention taken along line 4—4 of FIG. 3.

As shown in FIG. 4, the core members 12*a*, 12*b* are maintained in close position by means 16 looped around and connected to opposite ends of the pair of core members 12*a*, 12*b* to provide a two-ply core have the desired overall thickness. The means 16 looped around and connected to the opposite ends of core members 12*a*, 12*b* may be strips of pressure sensitive sheet material such as clear tape.

The two-ply core 12*a*, 12*b* may be made from a variety of materials such as plastic or cardboard. The parts of the core are generally thin, stiff and rectangular in shape and of such size that the finished package will easily fit into the pocket of a garment such as a shirt. For example, the core is short, preferably about 4" long, substantially the same width as the tape, for example 2" wide. The thickness of each piece of the core is in part determined by the stiffness and strength of the core. The combined thickness should provide enough strength for facilitating winding of the pressure sensitive tape onto the core.

Figure 5:
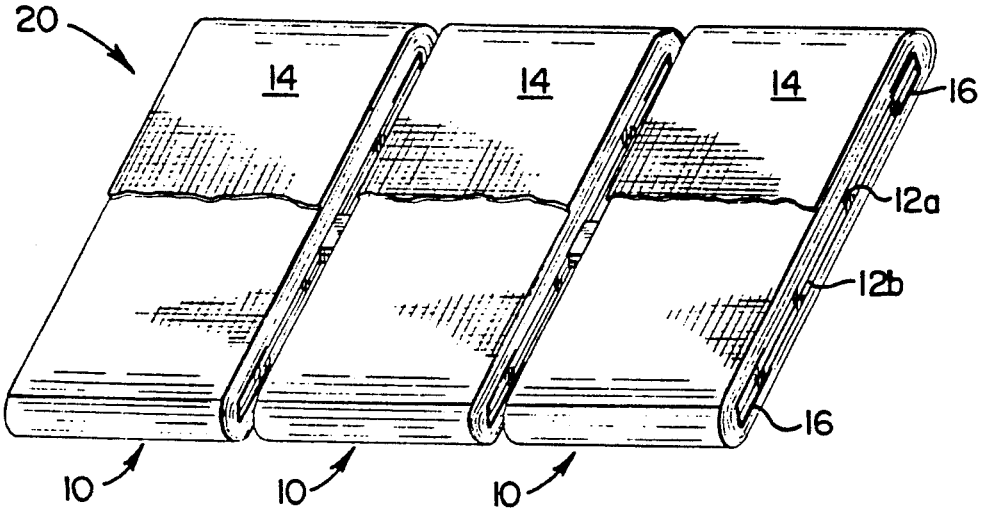
FIG. 5 is a perspective view of a plurality of convolutely wound core material prior to forming into separate packages.

The packages are conveniently produced by placing a number of the two-ply cores on a relatively flat mandrel. The plies of the cores may be separately placed on the mandrel in the form of a single ply forming one half of the core whereby the individual packages are separated after winding. FIG. 5 illustrates the phase of the package producing process wherein a plurality of side-by-side tapes have been wound onto a flat rectangular two-ply core 20 of such size as to make a plurality of individual packages. Depending on the particular winding machine used, about 30 packages may be wound at one time. After winding, the cores are removed from the mandrel. In the illustration shown in FIG. 5 the packages of duct tape are separated into individual packages. By winding the tape packages onto a two-ply core a package of tape is produced that does not have buckling distortion and tends to remain flat during its lifetime.

It should be understood that the pressure sensitive tape may be of any number of types and descriptions such as duct tape.

Since many variations, modifications, and changes in detail may be made to the embodiment described in the foregoing description and shown in the accompanying drawings without departing from the scope and spirit of the invention, the description of the drawings shall be interpreted as illustrative and not in a limiting sense.

What is claimed is:

1. A package of pressure sensitive tape characterized by having an overall size so as to readily fit the pocket of a garment such as a shirt for ease in carrying and for ready accessibility, said package comprising a relatively thin, stiff and short two-ply rectangular core, and a predetermined length of pressure sensitive tape not exceeding about 10 to 20 feet convolutely wound around said rectangular core to form a plurality of superposed layers, and wherein the width of said pressure sensitive tape is substantially the same as the width of said core.

2. A package of pressure sensitive tape according to claim 1 wherein said relatively thin, stiff core comprises a cylindrical member that has been permanently compressed and flattened into a relatively flat two-ply member having a rectangular shape.

3. A package of pressure sensitive tape according to claim 1 wherein said relatively thin, stiff rectangular two-ply core comprises a pair of juxtapositioned and separate core members each of substantially the same size, and means looped around and connected to opposite ends of said pair of core members for maintaining the pair of core members in close juxtaposition to each other to provide the desired overall thickness of core for facilitating the winding of the pressure sensitive tape on the core.

4. A package of pressure sensitive tape according to claim 3 wherein said pair of core members are formed of flat plastic material of a predetermined thickness so as to collectively provide the desired overall core thickness for facilitating the winding of said pressure sensitive tape thereon.

5. A package of pressure sensitive tape accord to claim 3 wherein said means looped around and connected to opposite ends of said pair of members comprises strips of pressure sensitive sheet material.

6. A package of pressure sensitive tape accord to claim 1 wherein the cross-sectional thickness of said wound pressure sensitive tape on each side of said core is no greater than the overall thickness of said core so as to provide a relatively small package for facilitating handling thereof.

7. A package of pressure sensitive tape according to claim 1 wherein said pressure sensitive tape is a cloth tape.

* * * * *